US006836084B2

(12) United States Patent
Shin et al.

(10) Patent No.: US 6,836,084 B2
(45) Date of Patent: Dec. 28, 2004

(54) HORIZONTAL DEFLECTION COIL FOR DEFLECTION YOKE

(75) Inventors: Dong-Chol Shin, Suwon-si (KR); Gong-Hee Park, Ansan-si (KR)

(73) Assignee: Samsung Electro-Mechanics Co., Ltd., Kyunggi-Do (KR)

( * ) Notice: Subject to any disclaimer, the term of this patent is extended or adjusted under 35 U.S.C. 154(b) by 0 days.

(21) Appl. No.: 10/659,595

(22) Filed: Sep. 10, 2003

(65) Prior Publication Data

US 2004/0174123 A1 Sep. 9, 2004

(30) Foreign Application Priority Data

Feb. 25, 2003 (KR) ..... 10-2003-0011739

(51) Int. Cl.[7] ..... H01J 29/56

(52) U.S. Cl. ..... 315/370; 315/371

(58) Field of Search ..... 315/370, 371

(56) References Cited

U.S. PATENT DOCUMENTS 4,910,441 A * 3/1990 Wetta ..... 315/371
6,498,443 B2 * 12/2002 Ueda et al. ..... 315/368.11

FOREIGN PATENT DOCUMENTS

KR 2000-77386 12/2000

* cited by examiner

*Primary Examiner*—David Vu
(74) *Attorney, Agent, or Firm*—Gottlieb, Rackman & Reisman, P.C.

(57) ABSTRACT

Disclosed herein is a horizontal deflection coil for a deflection yoke. The horizontal deflection coil includes an inner pincushion improving section connected to a screen bent, and sub-sections connected to the inner pincushion improving section. The inner pincushion improving section is disposed in an angular range of 45 to 60 degrees. The sub-sections include a horizontal color registration improving section for preventing a horizontal component of a green color from being widened, and a vertical color registration improving section for preventing a vertical component of the green color from being widened.

10 Claims, 8 Drawing Sheets

HORIZONTAL DEFLECTION COIL FOR DEFLECTION YOKE

BACKGROUND OF THE INVENTION

1. Field of the Invention

The present invention relates generally to a horizontal deflection coil for a deflection yoke used in a cathode ray tube, and more particularly to a horizontal deflection coil for a deflection yoke, which is provided with a section for correcting inner pincushion distortion, thereby removing the need for another circuit for correcting the inner pincushion distortion.

2. Description of the Prior Art

Recently, the market trend for display apparatuses pursues flatness, large size, high-resolution, low power consumption, and slimness that enables installation space to be reduced and the efficiency of use of space to be increased.

A computer monitor that is one of such display apparatus has been developed in pursuit of flatness, large size, high-resolution, low power consumption and slimness. Particularly, high quality display apparatuses, in which power consumption is reduced and effective screens are large-sized, are required to follow stringent environmental regulations.

The monitor market has been developing at 10% annually, and is divided into a Cathode Ray Tube (CRT) monitor market and a Liquid Crystal Display (LCD) monitor market.

However, with rapid progress of relevant technologies, the LCD monitor market has been developing at 50% annually, compared to the CRT monitor market. Accordingly, in this situation, CRT monitors are required to improve their quality and have competitive power in order to compete with LCD monitors.

The maximum share of the CRT monitor market is occupied by 17"~19" flat screen monitors to meet the market trend toward large sizes and flatness.

FIG. 1 shows an example of a conventional CRT, which shows a conventional curved screen CRT.

The conventional curved screen CRT includes a convex screen panel 1 that is curved outward at its front surface, a funnel 2 that is attached to the back end of the screen panel 1 using frit glass and maintains the inside of the CRT in a vacuum state, an electron gun 5 that is mounted in a neck 7 positioned at the rear of the funnel 2 and irradiates electron beams 4*a*, 4*b* and 4*c*, and a deflection yoke 6 that deflects the electron beams 4*a*, 4*b* and 4*c* irradiated from the electron gun 5 in left, right, up and down directions.

The deflection yoke 6 is used to apply horizontal and vertical deflection magnetic fields to the neck 7 of the CRT. The deflection yoke 6 includes a vertical deflection coil (not shown) that vertically deflects the electron beams 4*a*, 4*b* and 4*c* by applying the vertical deflection magnetic field to the electron beams 4*a*, 4*b* and 4*c* irradiated from the electron gun 5 of the CRT, a horizontal deflection coil (not shown) that horizontally deflects the electron beams 4*a*, 4*b* and 4*c* by applying the horizontal deflection magnetic field to the electron beams 4*a*, 4*b* and 4*c* irradiated from the electron gun 5 of the CRT, a separator (not shown) that precisely separates the horizontal deflection coil from the vertical deflection coil and electrically insulates the horizontal deflection coil from the vertical deflection coil, and a ferrite core (not shown) that enhances magnetic fields applied by the horizontal and vertical deflection coils.

The horizontal deflection coil and the vertical deflection coil are arranged to be perpendicular to each other in order to apply horizontal and vertical deflection magnetic fields to the electron beams 4*a*, 4*b* and 4*c* irradiated from the electron gun 5.

In such a curved screen CRT monitor, the screen panel 1 is curved to be protruded outward, deflection distances between the deflection yoke 6 and the fluorescent surface of a screen do not greatly differ from each other in the upper, middle and lower portions of the screen, so that distortion is limitedly generated.

That is, as shown in FIG. 1, in the conventional curved screen panel 1, a deflection distance A of the electron beam 4*a* irradiated onto the upper portion of the screen, a deflection distance B of the electron beam 4*b* irradiated onto the middle portion of the screen and a deflection distance C of the electron beam 4*c* irradiated onto the lower portion of the screen do not greatly differ from each other, so that distortion is limitedly generated.

However, the recent display market trend pursues flatness of a screen, whose panel is constructed to be flat, as described above, so that a screen panel 11 is formed to be flat, as shown in FIG. 2.

A CRT provided with the flat screen panel 11 has various merits compared to the conventional curved screen monitor, while the CRT has a defect of increased distortion characteristics.

That is, since the screen panel 11 is flat, as shown in FIG. 2, a deflection distance A' of the electron beam 14*a* irradiated onto the upper portion of the screen, a deflection distance B' of the electron beam 14*b* irradiated onto the middle portion of the screen and a deflection distance C' of the electron beam 14*c* irradiated onto the lower portion of the screen differ from each other, so that distortion is generated.

As the deflection distances A', B' and C' differ from each other, an inner pincushion phenomenon resulting from distortion is generated in the front surface of the screen as shown in FIG. 3.

In general, a picture is formed by a deflection yoke that forms a pincushion-shaped magnetic field using a horizontal deflection coil and a barrel-shaped magnetic field using a vertical deflection coil. The inner pincushion phenomenon almost does not appear due to the curvature of the CRT in a general curved screen panel, or is invisible to the naked eye when it appears in the curved screen panel.

However, it is found that the inner pincushion phenomenon appears in a flat CRT because vertical pincushion distortion is incompletely corrected in a central portion of an area between the central portion and each side end of the screen.

The inner pincushion phenomenon is pincushion distortion in which a picture displayed on the CRT becomes curved inward in a central portion of an area between the central portion and each side end of the screen as indicated by solid lines shown in FIG. 3.

That is, the vertical lines of the screen should appear as straight lines to connect the upper, middle and lower portions of the screen as indicated by dotted lines shown in FIG. 3. However, if the inner pincushion phenomenon described above is generated, a picture seems to be curved inward, so that the quality of the screen is decreased and high quality of the CRT may not be offered.

Accordingly, an additional circuit is used in the deflection yoke to improve the inner pincushion phenomenon, and the circuit is referred to as an inner pincushion correction module.

The inner pincushion correction module is an additional circuit that may remove pincushion distortion in order to correct the vertical pincushion distortion, which is caused by horizontal deflection coils that forms a pincushion-shaped magnetic field.

The inner pincushion correction module is operated by an induced electromotive force caused by a mutual inductance between vertical and horizontal deflection coils.

An example of the conventional inner pincushion correction module is shown in FIG. 4, and is described with reference to FIG. 4.

Two horizontal correction coils L3 and L4 are wound to generate reverse magnetic fields, and permanent magnets 19 and 20 for apply a fixed deflection magnetic field to the horizontal correction coils L3 and L4 and a vertical correction coil L7 are disposed.

The horizontal correction coils L3 and L4 receive the fixed deflection magnetic field applied by the permanent magnets 19 and 20. The size of the central portion of the screen becomes small and the sizes of the corners of the screen become identical by the action of the vertical correction coil L7, so that left and right pincushion distortions are corrected.

If current flows into the horizontal correction coils L3 and L4, as shown in FIG. 4, a magnetic field is generated by the left horizontal correction coil L3 in the direction opposite to that of the fixed deflection magnetic field, and another magnetic field is generated by the right horizontal correction coil L4 in the direction identical to that of the fixed deflection magnetic field.

In this case, the direction of the magnetic field generated by the left horizontal correction coil L3 is opposite to that of the fixed deflection magnetic field by the action of the permanent magnets 19 and 20.

The inner pincushion correction module constructed as described above is operated by an induced electromotive force caused by a mutual inductance between the vertical and horizontal correction coils L7, L3 and L4, so that horizontal correction coils L3 and L4 form a pincushion-shaped magnetic field, thereby correcting the vertical pincushion distortion.

However, a conventional flat screen CRT is disadvantageous in that a separate inner pincushion correction module should necessarily be used to correct, the inner pincushion distortion.

For this reason, the manufacturing cost of the flat screen CRT is increased due to an increase in number of assembly steps required to attach the inner pincushion correction module to the deflection yoke, as well as an increase in number of parts required to manufacture the inner pincushion correction module.

SUMMARY OF THE INVENTION

Accordingly, the present invention has been made keeping in mind the above problems occurring in the prior art, and an object of the present invention is to provide a deflection yoke, which corrects inner pincushion distortion using a horizontal deflection coil constituting the deflection yoke, without using an inner pincushion correction circuit.

In order to accomplish the above object, the present invention provides a horizontal deflection coil for a deflection yoke including an inner pincushion improving section connected to a screen bent, and sub-sections connected to the inner pincushion improving section, wherein the inner pincushion improving section is disposed in an angular range of 45 to 60 degrees, and the sub-sections include a horizontal color registration improving section for preventing a horizontal component of a green color from being widened, and a vertical color registration improving section for preventing a vertical component of the green color from being widened.

Preferably, the HCR improving section may be connected at its first screen-side end to the screen bent and connected at its second end to the inner pincushion improving section, and the VCR improving section may be connected at its first screen-side end to a position where the inner pincushion improving section and the screen bent are connected to each other and connected at its second end to another adjacent section.

Preferably, the HCR improving section may be connected at the second end to a position corresponding to one-half to two-thirds of a length of the inner pincushion improving section.

Preferably, the VCR improving section may be formed to be parallel to the HCR improving section.

Preferably, the number of turns of wires of the inner pincushion improving section may be greater than the sum of the numbers of turns of wires of HCR and VCR improving sections.

In addition, the present invention provides a deflection yoke including a horizontal deflection coil provided with an inner pincushion improving section, a HCR improving section for preventing a horizontal component of a green color from being widened, and a VCR improving section for preventing a vertical component of the green color from being widened, the HCR and VCR improving sections being sub-sections, wherein a inner pincushion correction module for correcting inner pincushion is omissible.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Figure 1:
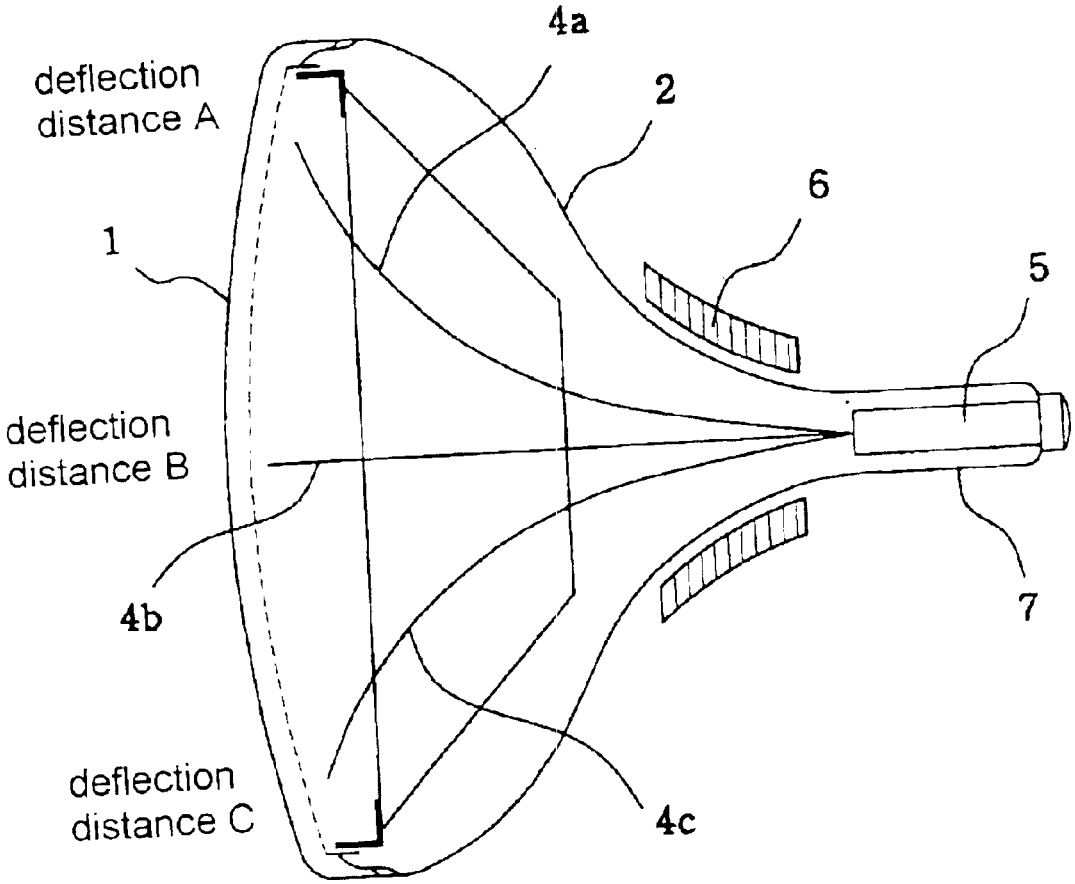
FIG. 1 PRIOR ART
FIG. 1 is a schematic side section view of a conventional curved screen CRT.
Figure 2:
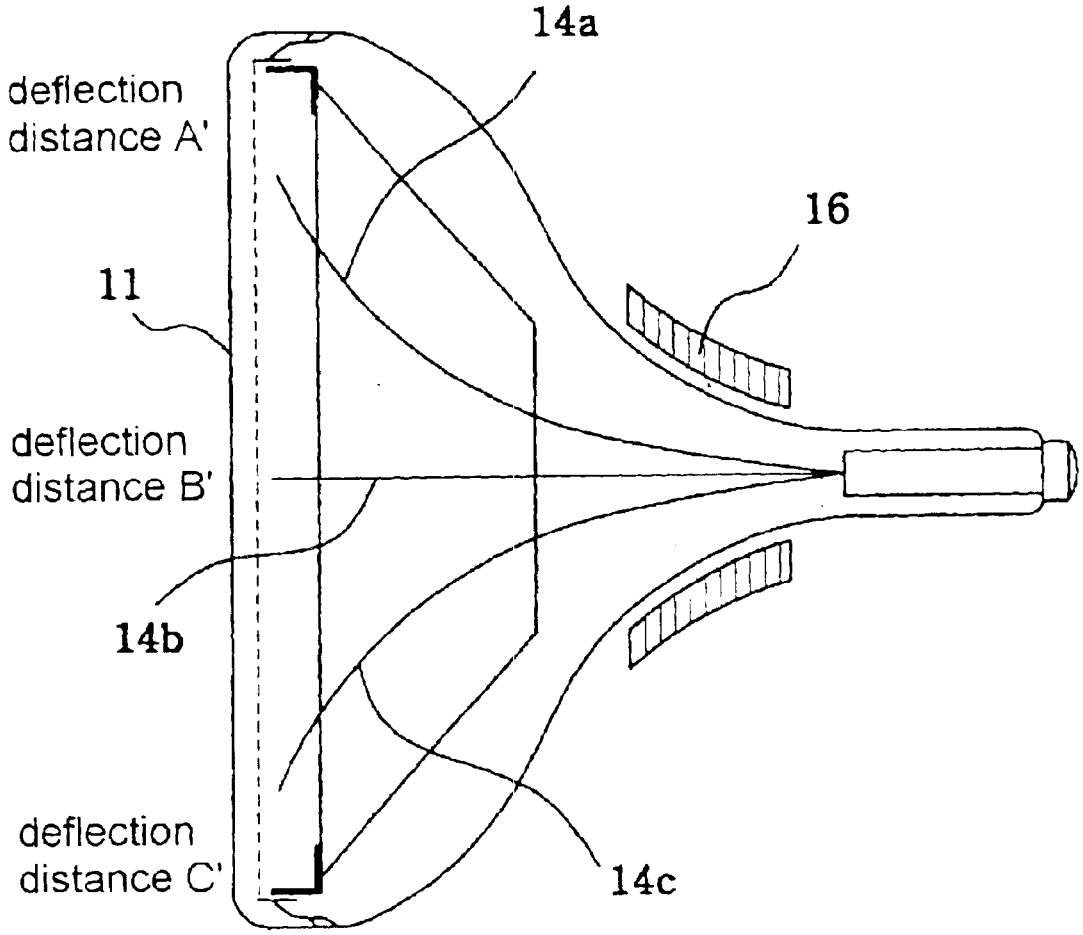
FIG. 2 PRIOR ART
FIG. 2 is a schematic side section view of a conventional flat screen CRT.
Figure 3:
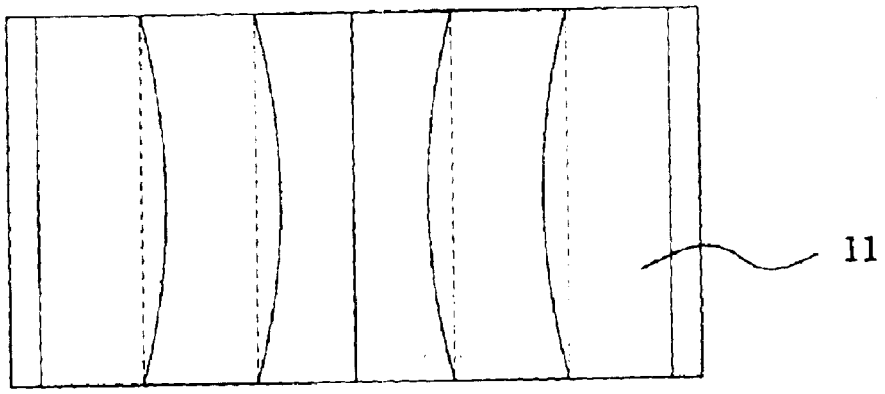
FIG. 3 PRIOR ART
FIG. 3 is a front view of general inner pincushion distortion.
Figure 4:
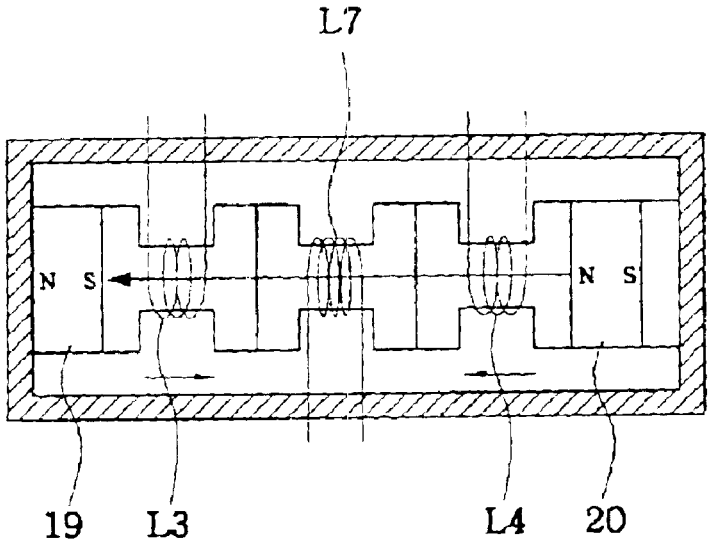
FIG. 4 PRIOR ART
FIG. 4 is a section view of a circuit of a conventional inner pincushion correction module for correcting inner pincushion.

Reference now should be made to the drawings, in which the same reference numerals are used throughout the different drawings to designate the same or similar components.

Hereinafter, a horizontal deflection coil for a deflection yoke according to the present invention is described with reference to the accompanying drawings.

Figure 5:
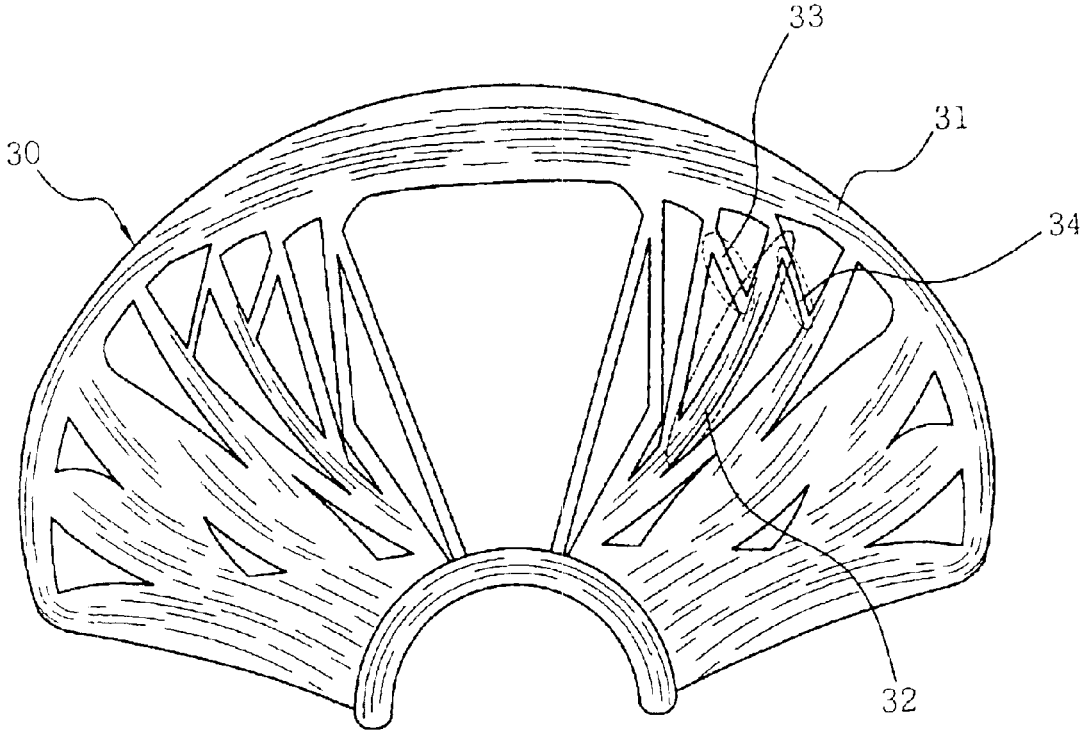
FIG. 5 is a front view of a horizontal deflection coil in accordance with the present invention.

As shown in FIG. 5, a horizontal deflection coil 30 of the present invention is provided with an inner pincushion improving section 32 that may correct inner pincushion distortion.

The inner pincushion improving section 32 is formed to be connected to a screen bent 31 of the horizontal deflection coil 30, and to be disposed in the angular range of 45 to 60 degrees.

In general, in a conventional horizontal deflection coil, a section connected to a screen bent is not formed to be disposed in the range of 50 and more degrees. The reason for this is that a section disposed in the angular range of 50 and more degrees has good characteristics for red and blue colors and bad characteristics for a green color.

That is, if the section connected to the screen bent is formed to be disposed in the angular range of 50 and more degrees, there is a problem in that Horizontal Color Registration (HCR) distortion and Vertical Color Registration (VCR) distortion are generated.

VCR distortion means misconvergence that is caused by errors generated because red and blue beams correctly hit proper pixels on a screen but a green beam does not correctly hit proper pixels on the screen in a vertical direction. HCR distortion means misconvergence that is caused by errors generated because red and blue beams correctly hit proper pixels on a screen but a green beam do not correctly hit proper pixels on the screen in a horizontal direction.

As described above, in the conventional horizontal deflection coil, if the section connected to the screen bent is formed to be disposed in the angular range of 50 and more degrees, picture quality is decreased due to the generation of HCR distortion and VCR distortion, so that the section connected to the screen bent is not allowed to be disposed in the angular range of 50 and more degrees.

In contrast, the horizontal deflection coil 30 of the present invention is provided with the inner pincushion improving section 32 that is connected to the screen bent 31 and disposed in the angular range of 45 to 60 degrees. The inner pincushion improving section 32 is connected to each of two sub-sections.

The two sub-sections are used to correct HCR distortion and VCR distortion caused by disposing the inner pincushion improving section 32 in the angular range of 45 to 60 degrees.

That is, the two sub-sections are an HCR improving section 33 that prevents the horizontal component of a green color from being widely displayed, and a VCR improving section 34 that prevents the vertical component of a green color from being widely displayed.

The HCR improving section 33 is connected at its screen-side end to the screen bent 31, and connected at its other end to the inner pincushion improving section 32.

Additionally, the VCR improving section 34 is connected at a screen-side end to a position where the inner pincushion improving section 32 and the screen bent 31 are connected to each other, and connected at its other end to another adjacent section.

In this case, the length, angle and position of both the HCR improving section 33 and VCR improving section 34 are very important. When the HCR improving section 33 of the present invention is connected at its screen-side end to the screen bent 31 and connected at its other end to the inner pincushion improving section 32, the HCR improving section 33 is connected at the latter end to a position corresponding to one-half to two-thirds of the length of the inner pincushion improving section 32.

That is, since the inner pincushion improving section 32 is connected to the screen bent 31 and disposed in the angular range of 45 to 60 degrees, and the HCR improving section 33 is connected at the latter end to the position corresponding to one-half to two-thirds of the length of the inner pincushion improving section 32, a figure formed by the HCR improving section 33 and the inner pincushion improving section 32 looks like a small letter 'y'.

Additionally, when the VCR improving section 34 is connected at its one end to inner pincushion improving section 32 connected to the screen bent 31 and connected at its other end to the other adjacent section, the VCR improving section 34 is formed to be parallel to the HCR improving section 33.

Additionally, the latter end of the VCR improving section 34 is connected to the other adjacent section so that the VCR improving section 34 is formed to be parallel to the HCR improving section 33.

As described above, the former end of the VCR improving section 34 is connected to the inner pincushion improving section connected to the screen bent 31, and the latter end of the VCR improving section 34 is connected to the other adjacent section so that the VCR improving section 34 is parallel to the HCR improving section 33. Accordingly, a figure formed by the HCR improving section 33, the inner pincushion improving section 32 and the VCR improving section 34 connected to each other looks like an inverted 'N'.

The HCR improving section 33, the inner pincushion improving section 32 and the VCR improving section 34 are symmetrically formed on both sides of the horizontal deflection coil. In this case, the wires of each of the inner pincushion improving section 32, the HCR improving section 33 and the VCR improving section 34 are distributed so that the number of turns of wires of the inner pincushion improving section 32 is greater than the sum of the numbers of turns of wires of the HCR improving section 33 and the VCR improving section 34.

The operation of the horizontal deflection coil of the present invention constructed as described above will now be described.

Figure 6:
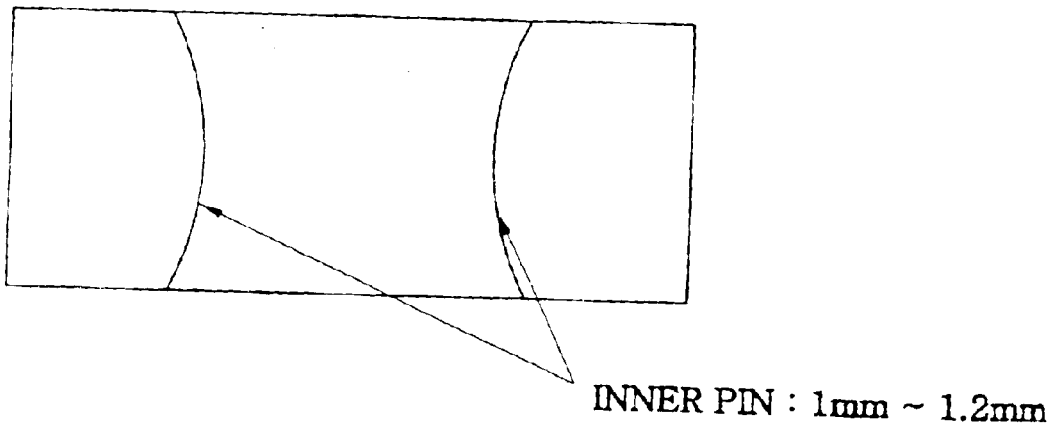
FIG. 6 shows distortion on a screen in the case where an inner pincushion improving section and sub-sections according to the present invention are not included.

When a conventional horizontal deflection coil without the inner pincushion improving section 32, the HCR improving section 33 and the VCR improving section 34 is disposed, the inner pincushion, in which a picture displayed on a screen is curved inward in a central portion of an area between the central portion and each side end of the screen, is generated, as shown in FIG. 6.

In this case, the amount of inner pincushion distortion is 1~1.2 mm.

Accordingly, in the case of a CRT provided with the conventional horizontal deflection coil, inner pincushion distortion of 1~1.2 mm is generated in a central portion of an area between the central portion and each side end of the screen, so that a picture displayed on the screen is uniform and curved inward in the central portion of the screen, thereby greatly reducing picture quality.

Figure 7:
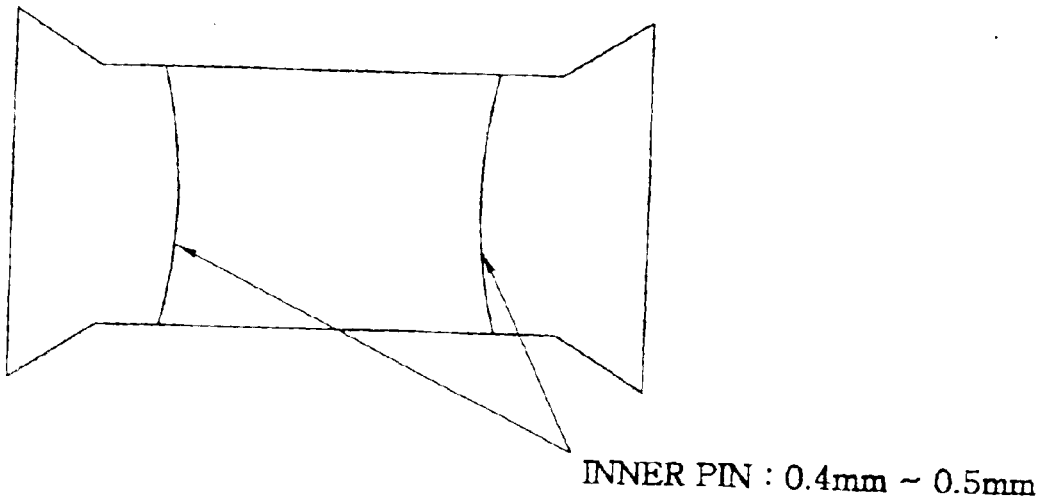
FIG. 7 shows distortion on a screen in the case where an inner pincushion improving section according to the present invention is included.

Meanwhile, in the case where the conventional horizontal deflection coil is provided with the sections 33 and 34 disposed in the angular range of 45 to 60 degrees so that the sections 33 and 34 are each connected to the screen bent 31, distortion on a screen is shown in FIG. 7.

That is, when the inner pincushion improving section 32 is disposed in the angular range of 45 to 60 degrees, North-South (NS) pincushion distortion is greatly generated in upper and lower portions of the screen and slight inner pincushion distortion is generated, as shown in FIG. 7.

In this case, the amount of distortion caused by the horizontal deflection coil having the inner pincushion improving section 32 is 0.4~0.5 mm that is smaller than that caused by the conventional horizontal deflection coil, and is reduced to be half compared to the inner pincushion distortion of 1~1.2 mm in the case of the conventional horizontal deflection coil.

Accordingly, the inner pincushion improving section 32 of the present invention is very effective in reducing the inner pincushion distortion.

Figure 8:
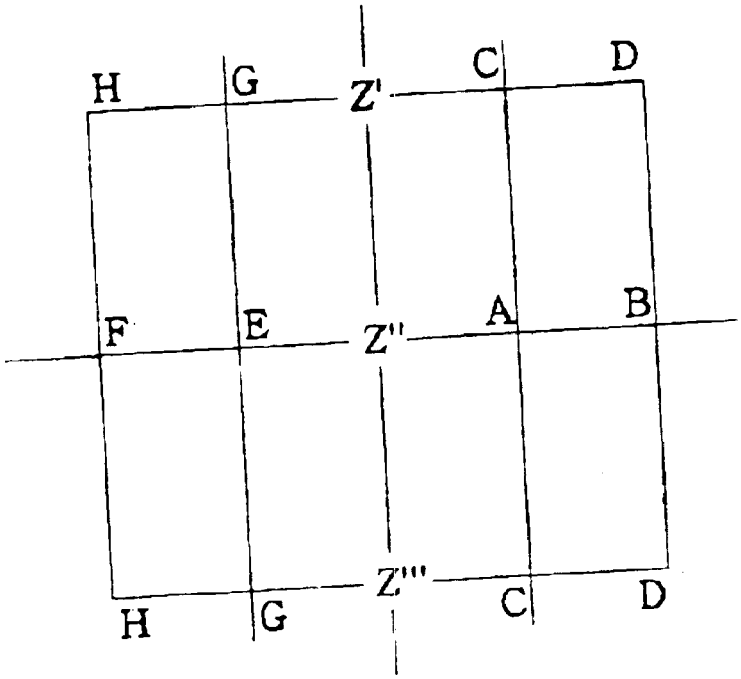
FIG. 8 is a front view illustrating an effective picture of a screen.

FIG. 8 is a front view illustrating an effective picture of a screen to illustrate distortion on a screen. The inner pincushion improving section 32 allows a distance AB between points A and B to be shorter than a distance CD between points C and D, and allows a distance AC between points A and C to be shorter than a distance BD between points B and D, thereby partially applying a magnetic field to edge points D.

When the distances between AB and CD are allowed to be identical using a pincushion circuit, a distance Z'C between points Z' and C is reduced.

Since a distance Z"A between points Z" and A is shorter than the distance Z'C between points Z' and C, the distances Z"A and Z' C become identical if the distance Z'C is reduced as described above, so that inner pincushion distortion is removed.

However, in the case of a horizontal deflection coil having only an inner pincushion improving section 32, some problems are not solved. As described above, since the distance AC is shorter than the distance BD when the inner pincushion improving section 32 is formed in the horizontal deflection coil, NS pincushion distortion is generated.

In this case, the amount of NS pincushion distortion is 0.8~1 mm.

Additionally, HCR distortion, in which the horizontal component of a green color is widely displayed compared to those of red and blue colors, is generated.

In the case where the NS pincushion distortion is generated, the NS pincushion distortion may become barrel distortion using the difference between sensitivities of a horizontal deflection coil and a vertical deflection coil.

The NS pincushion distortion characteristics may be improved while inner pincushion distortion characteristics improved by the inner pincushion improving section 32 are similarly maintained.

However, if the NS pincushion distortion may become barrel distortion using the difference between sensitivities of the horizontal deflection coil and the vertical deflection coil, the inner pincushion distortion characteristics and the NS pincushion distortion characteristics are improved, but another problem may be generated due to the inner pincushion and NS pincushion characteristics.

In this case, HCR distortion, in which the horizontal component of a green color is widely displayed compared to those of red and blue colors, is generated in the corners of a screen.

That is, if the inner pincushion improving section 32 is formed to prevent inner pincushion distortion, inner pincushion distortion is improved, but NS pincushion distortion and HCR distortion are generated. If NS pincushion distortion may become barrel distortion using the difference between sensitivities of the horizontal deflection coil and the vertical deflection coil to improve NS pincushion characteristics, the inner pincushion distortion characteristics and the NS pincushion distortion characteristics are improved, but VCR distortion is generated.

Figure 9:
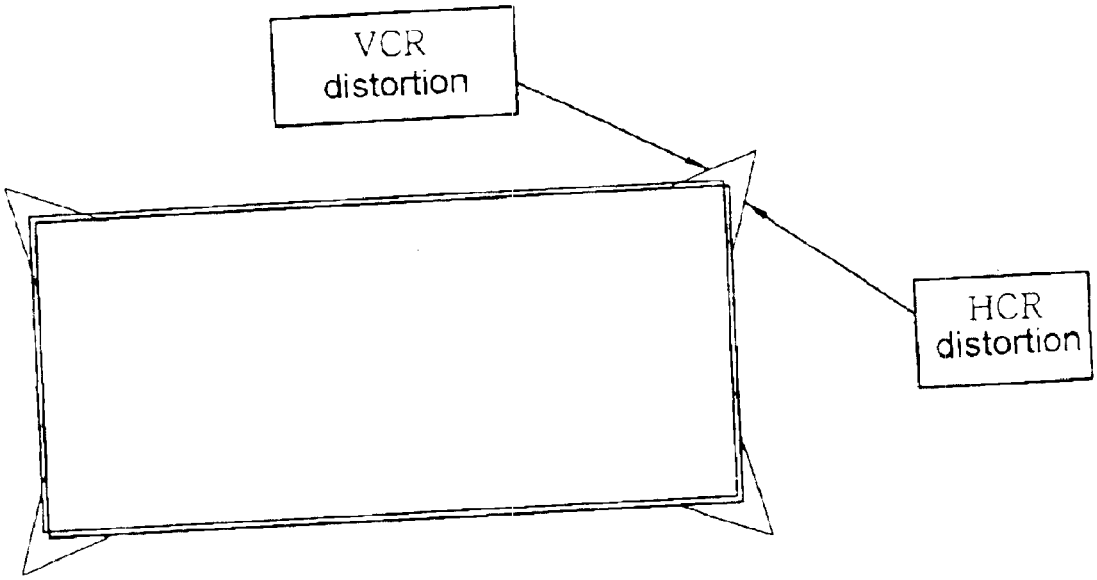
FIG. 9 shows HCR distortion and VCR distortion.

Accordingly, if the inner pincushion improving section 32 is formed in the horizontal deflection coil 30, inner pincushion distortion is corrected as shown in FIG. 9, but HCR distortion and VCR distortion are generated in all the corners of the screen.

Accordingly, other sub-sections are formed to solve problems described above. The sub-sections are used to correct HCR distortion and VCR distortion caused by disposing the inner pincushion improving section 32 in the angular range of 45 to 60 degrees. The sub-sections are the HCR improving section 33 that prevents the horizontal component of a green color from being widely displayed, and the VCR improving section 32 that prevents the vertical component of a green color from being widely displayed, respectively.

Figure 10:
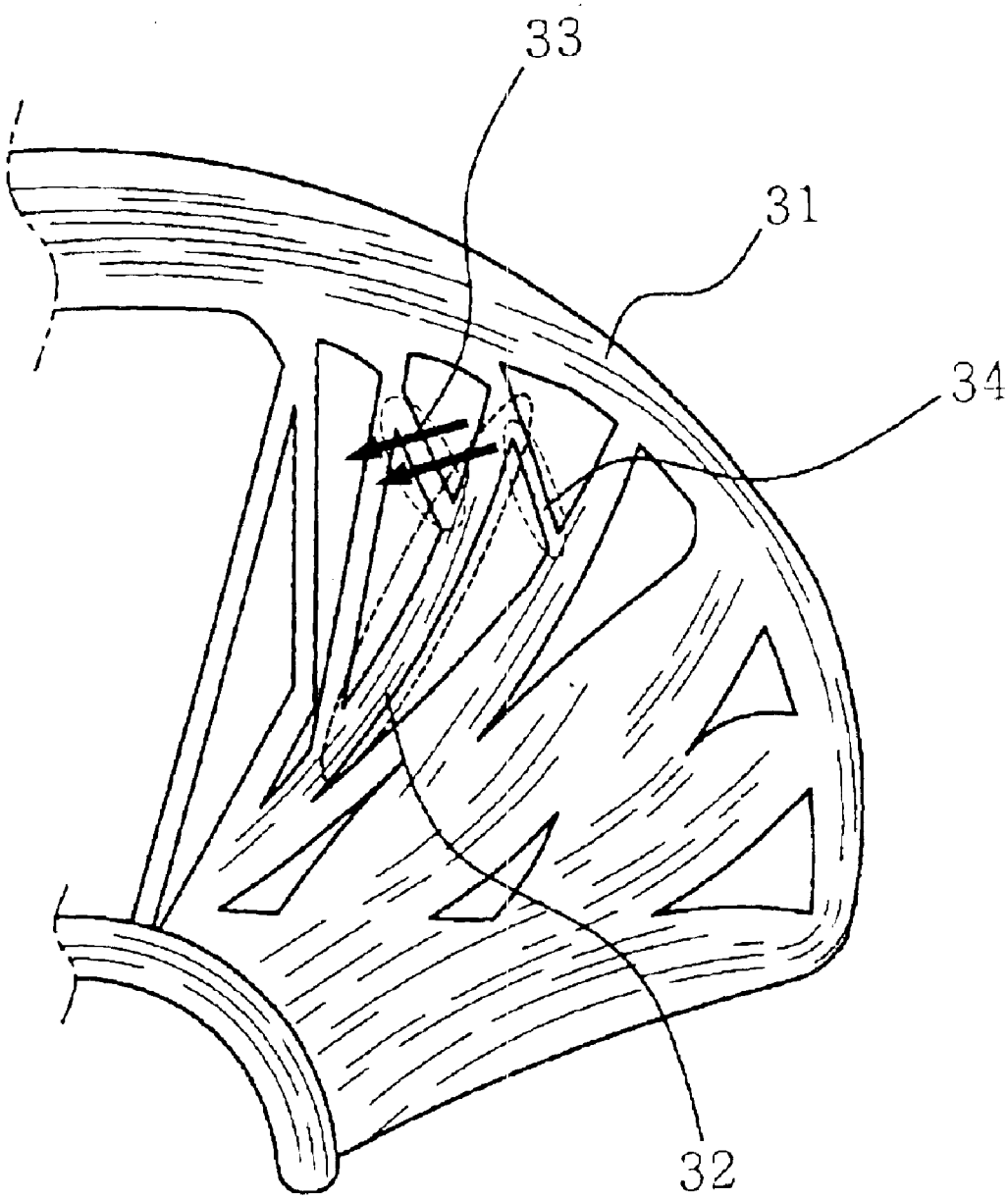
FIG. 10 shows an operation of a HCR improving section of the horizontal deflection coil in accordance with the present invention.

The HCR improving section 33 of the present invention is connected at its screen-side end to the screen bent 31 and connected at its other end to the position corresponding to one-half to two-thirds of the length of the inner pincushion improving section 32. The HCR improving section 33 formed as described above applies magnetic forces in the direction of arrows as shown in FIG. 10.

Accordingly, since the magnetic forces are applied to in reduce HCR distortion as in FIG. 9, the horizontal component of a green color is prevented from being widely displayed.

Figure 11:
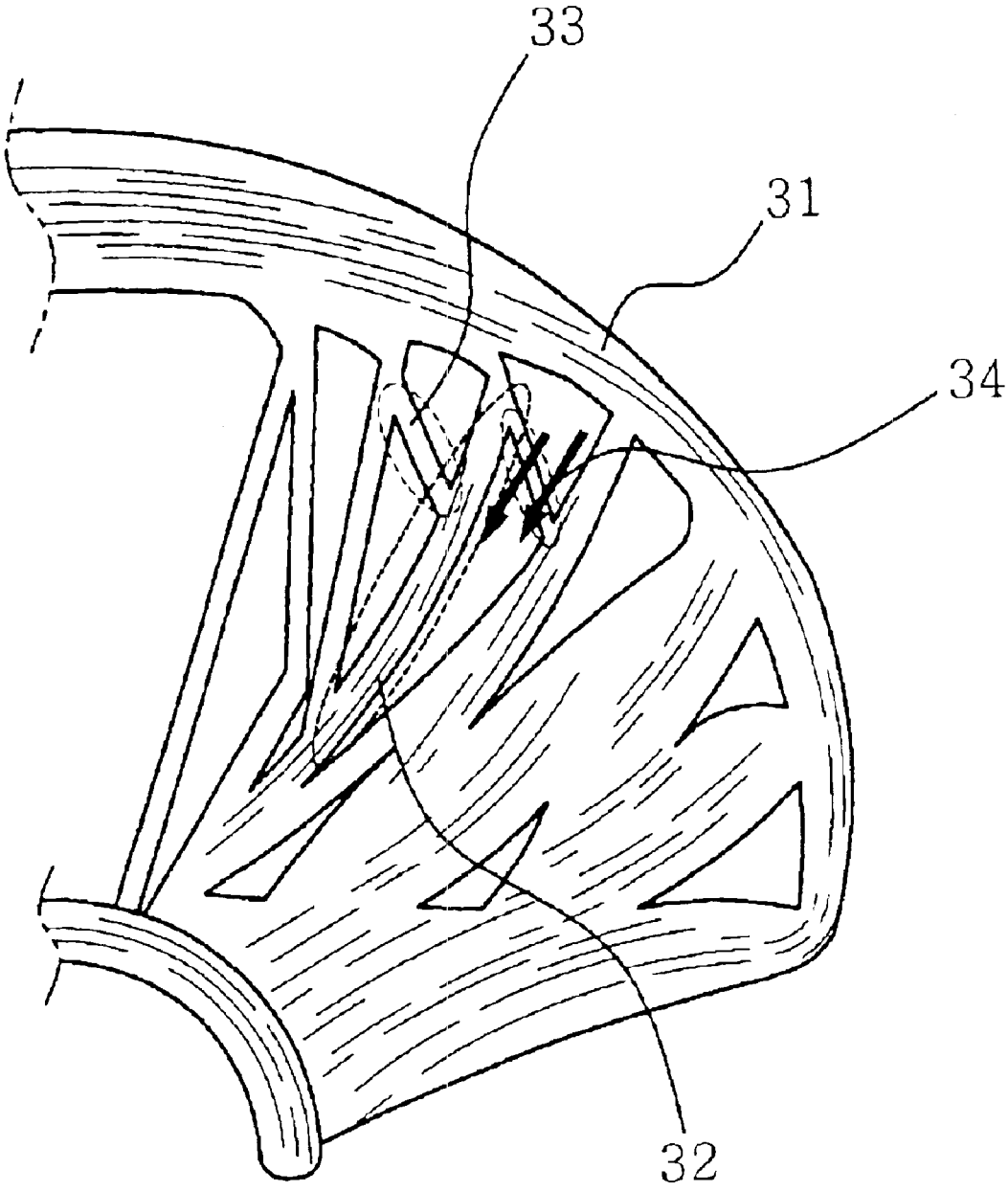
FIG. 11 shows an operation of a VCR improving section of the horizontal deflection coil in accordance with the present invention.

Additionally, the VCR improving section 34 is connected at its screen-side end to the position where the inner pincushion improving section 32 and the screen bent 31 are connected to each other, and connected at its other end to the other adjacent section so that the VCR improving section 34 is parallel to the HCR improving section 33. The VCR improving section 34 formed as described above applies magnetic forces in the direction of arrows as shown in FIG. 11.

Accordingly, since the magnetic forces are applied in the direction of reducing VCR distortion, as in FIG. 9, the horizontal component of a green color is prevented from being widely displayed.

Accordingly, the HCR distortion and the VCR distortion may be removed by the two sub-sections, respectively.

Improved changes resulting from the operations of the inner pincushion improving section 32, the HCR improving section 33 and VCR improving section 34 are indicated in Table 1.

TABLE 1

| Item | Conventional product | First developed product | Second developed product | Third developed product | Fourth developed product | Conventional product vs. fourth developed product |
|---|---|---|---|---|---|---|
| INNER PINCUSHION improving Section | Nothing | Existence | Existence | Existence | Existence | |
| HCR improving section | Nothing | Nothing | Existence | Nothing | Existence | |
| VCR improving section | Nothing | Nothing | Nothing | Existence | Existence | |
| Inner pincushion distortion (mm) | 1.3 | 0.4 | 0.4 | 0.4 | 0.4 | 0.9 |
| HCR distortion (mm) | 0.10 | 0.18 | 0.05 | 0.16 | 0.03 | 0.07 |
| VCR distortion (mm) | 0.10 | 0.18 | 0.16 | 0.05 | 0.03 | 0.07 |

As shown in Table 1, when a horizontal deflection coil is provided with the inner pincushion improving section 32 of the present invention (see the first developed product of the present invention), the amount of inner pincushion distortion is reduced from 1.3 mm to 0.4 mm.

However, inner pincushion is reduced, but the amounts of HCR distortion and VCR distortion are each increased from 0.1 mm to 0.18 mm.

Meanwhile, if a horizontal deflection coil is provided with the inner pincushion improving section 32 and HCR improving section 33 of the present invention (see the second developed product of the present invention), the amount of inner pincushion distortion is identical to that of the conventional product as 0.4 mm, and the amount of HCR distortion is reduced to 0.05 mm.

However, the amount of VCR distortion has increased greatly, to 0.16 mm.

Meanwhile, if a horizontal deflection coil is provided with the inner pincushion improving section 32 and VCR improving section 34 of the present invention (see the third developed product of the present invention), the amount of inner pincushion distortion is identical to that of the conventional product as 0.4 mm, and the amount of VCR distortion is reduced to 0.05 mm.

However, the amount of HCR distortion has increased greatly, to 0.16 mm.

Meanwhile, when a horizontal deflection coil is provided with the inner pincushion improving section 32, HCR improving section 33 and VCR improving section 34 of the present invention (see the fourth developed product of the present invention), the amount of inner pincushion distortion is identical to that of the conventional product as 0.4 mm, and the amounts of HCR distortion and VCR distortion are each reduced to 0.03 mm.

As a result, when a horizontal deflection coil is provided with the inner pincushion improving section 32, HCR improving section 33 and VCR improving section 34 of the present invention, the amount of inner pincushion distortion is 0.4 mm, and the amounts of HCR distortion and VCR distortion are each 0.03 mm.

When the fourth developed product of the present invention is compared to the conventional product, the amount of the inner pincushion distortion is improved by 0.9 mm, and the amounts of HCR distortion and VCR distortion are each improved by 0.07 mm.

Accordingly, the horizontal deflection coil improves the HCR distortion and the VCR distortion as well as the inner pincushion distortion.

As described above, the present invention is to provide a horizontal deflection coil for a deflection yoke, which is provided with an inner pincushion improving section that improves inner pincushion distortion, a HCR improving section that improves HCR distortion and a VCR improving section that improves VCR distortion, thereby correcting inner pincushion distortion using the horizontal deflection coil constituting the deflection yoke without using an additional inner pincushion correction circuit.

Accordingly, the inner pincushion correction circuit may be omitted in the conventional product, so that manufacturing cost may be reduced due to a decrease in steps of manufacturing the deflection yoke.

Additionally, HCR and VCR distortion characteristics may be improved.

Additionally, the design margin of a green color in the corners of a screen is sufficient, so that the processes of manufacturing the deflection yoke may be reduced.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A horizontal deflection coil for a deflection yoke, comprising:

an inner pincushion improving section connected to a screen bent, and sub-sections connected to the inner pincushion improving section;

wherein the inner pincushion improving section is disposed in an angular range of 45 to 60 degrees, and the sub-sections include a Horizontal Color Registration (HCR) improving section for preventing a horizontal component of a green color from being widened and a Vertical Color Registration (VCR) improving section for preventing a vertical component of the green color from being widened.

2. The horizontal detection coil according to claim 1, wherein the HCR improving section is connected at its first screen-side end to the screen bent and connected at its second end to the inner pincushion improving section, and the VCR improving section is connected at its first screen-side end to a position where the inner pincushion improving section and the screen bent are connected to each other and connected at its second end to another adjacent section.

3. The horizontal detection coil according to claim 2, wherein the HCR improving section is connected at the second end to a position corresponding to one-half to two-thirds of a length of the inner pincushion improving section.

4. The horizontal detection coil according to claim 2 or 3, wherein the VCR improving section is formed to be parallel to the HCR improving section.

5. The horizontal detection coil according to claim 1, wherein a number of turns of wires of the inner pincushion improving section is greater than a sum of numbers of turns of wires of HCR and VCR improving sections.

6. A deflection yoke, comprising:

a horizontal deflection coil provided with an inner pincushion improving section, an HCR improving section for preventing a horizontal component of a green color from being widened, and a VCR improving section for preventing a vertical component of the green color from being widened, the HCR and VCR improving sections being sub-sections;

wherein an inner pincushion correction module for correcting inner pincushion is omissible.

7. The deflection yoke according to claim 6, wherein the inner pincushion improving section is disposed in an angular range of 45 to 60 degrees, the HCR improving section is connected at a first screen-side end to a screen bent and connected at a second end to the inner pincushion improving section, and the VCR improving section is connected at a first end to a position where the inner pincushion improving section and the screen bent are connected to each other and connected at a second end to another adjacent section.

8. The deflection yoke according to claim 7, wherein the HCR improving section is connected at the second end to a position corresponding to one-half to two-thirds of a length of the inner pincushion improving section.

9. The deflection yoke according to claim 7 or 8, wherein the VCR improving section is formed to be parallel to the HCR improving section.

10. The deflection yoke according to claim 6, wherein a number of turns of wires of the inner pincushion improving section are greater than a sum of numbers of turns of wires of HCR and VCR improving sections.

* * * * *